US005511244A

United States Patent [19]

Shikatani

[11] Patent Number: 5,511,244

[45] Date of Patent: Apr. 30, 1996

[54] HOCKEY GOALTENDER'S GLOVE WITH SPLIT TRAP

[75] Inventor: Brian H. Shikatani, Milton, Canada

[73] Assignee: Canstar Sports Groups, Inc., Ville Mont-Royal, Canada

[21] Appl. No.: 386,538

[22] Filed: Feb. 10, 1995

[30] Foreign Application Priority Data

Feb. 11, 1994 [CA] Canada ..... 2115526

[51] Int. Cl.[6] ..... A41D 13/10

[52] U.S. Cl. ..... 2/16; 2/19; 2/161.1

[58] Field of Search ..... 2/16, 19, 20, 159, 2/160, 161.1, 163

[56] References Cited

U.S. PATENT DOCUMENTS 2,485,882 10/1949 Hilton ..... 2/19

4,967,418 11/1990 Marcotte ..... 2/16

5,435,008 7/1995 Shane ..... 2/16

FOREIGN PATENT DOCUMENTS 2035824 8/1992 Canada ..... 2/16

*Primary Examiner*—Michael A. Neas

[57] ABSTRACT

A hockey goaltender's glove is described, in which the pocket is divided by a central web split into two side-by-side web portions along a substantial part of its length, or by two separate web portions, the web portions being tied by webbing such that a gap is created between them, spanned by webbing. By virtue of the web portions and the gap, the pocket flexes and closes around the puck more easily, thereby providing more reliable trapping of the puck.

4 Claims, 2 Drawing Sheets

22
24
10
20
18
3
2
8

HOCKEY GOALTENDER' S GLOVE WITH SPLIT TRAP

BACKGROUND OF THE INVENTION

This invention relates to ice hockey equipment, and in particular to goaltender's gloves.

A goaltender's glove is used primarily to catch a flying puck, or to "smother" a puck on the ice by covering it with the glove.

So that the goaltender or "goalie" can retain a caught puck, rather than having it bounce out of the glove and remain in play, it is common to have a webbed "pocket" or "trap" which traps the puck.

No pocket will retain a puck every time, especially since the glove must be constructed so that the goalie can also release a caught puck at will, and especially since the puck will not always impact the glove in the same orientation. An added factor is that the puck may impact the glove at varying speeds, from the 100 mile per hour range, down to nearly zero. The ideal glove would enable the goalie to trap the puck every time desired, and to release the puck whenever desired, regardless of orientation and speed.

SUMMARY OF THE INVENTION

It is an object of the invention to provide a goaltender's glove with an improved pocket. Although no glove can attain the above ideal, it has been found that a glove with a pocket configured according to the invention provides improved performance over gloves in the prior art.

In the invention, the glove has a pocket which is essentially conventional, but which is divided by a split or double web extending from the middle of the top web down to the bottom of the pocket, i.e. to where the thumb area meets the finger area. The web portions are tied via conventional laces or "webbing" such that they are flared apart from each other in the middle of the pocket, leaving a gap. By virtue of this configuration, the web portions readily fold over towards each other, so that the pocket flexes and closes around the puck more easily, thereby providing more reliable trapping of the puck.

Further features will be described or will become apparent in the course of the following detailed description.

BRIEF DESCRIPTION OF THE DRAWINGS

The invention will now be described in greater detail with reference to the accompanying drawings, in which.

DETAILED DESCRIPTION OF THE PREFERRED EMBODIMENT

Figure 1:
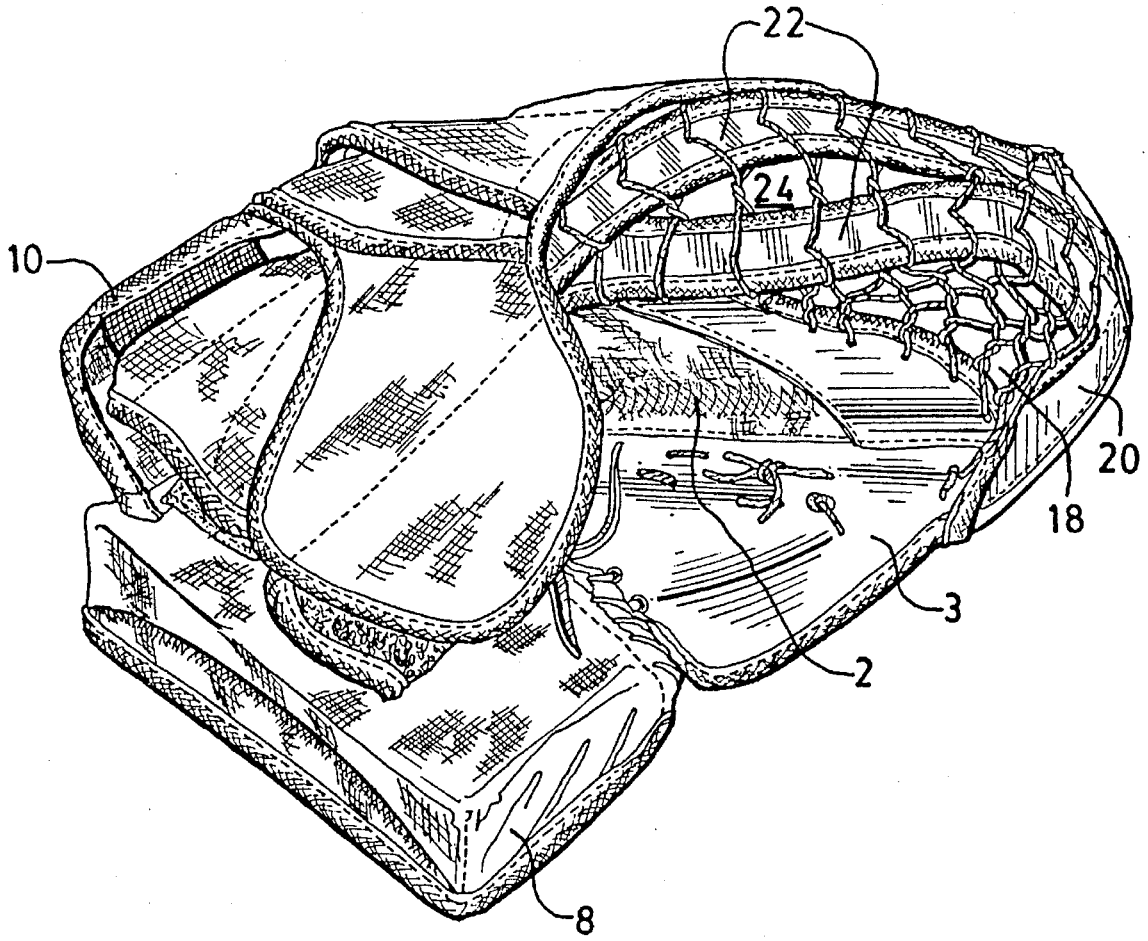
FIG. 1 is a perspective of the back of the glove.

The glove is conventional in most respects, having a thumb area 2, a thumb spoiler 3, a finger area 4, a pocket between the thumb and finger areas, a cuff protector 8, and a back cuff 10.

The pocket has laces or "webbing" 18 spanning the area between the thumb and finger areas. A top web 20 spans across the top of the pocket, from the tip of the thumb area to the tip of the finger area. This is conventional.

It is also conventional to provide a central web in the pocket, extending from the middle of the top web down to the bottom of the pocket, i.e. to where the thumb area meets the finger area. In the invention, however, instead of a single web, a double web is provided, comprising two web portions 22. The webbing 18 is tied through the web portions such that they are flared apart from each other in the middle of the pocket, leaving a gap 24 spanned by webbing.

Figure 2:
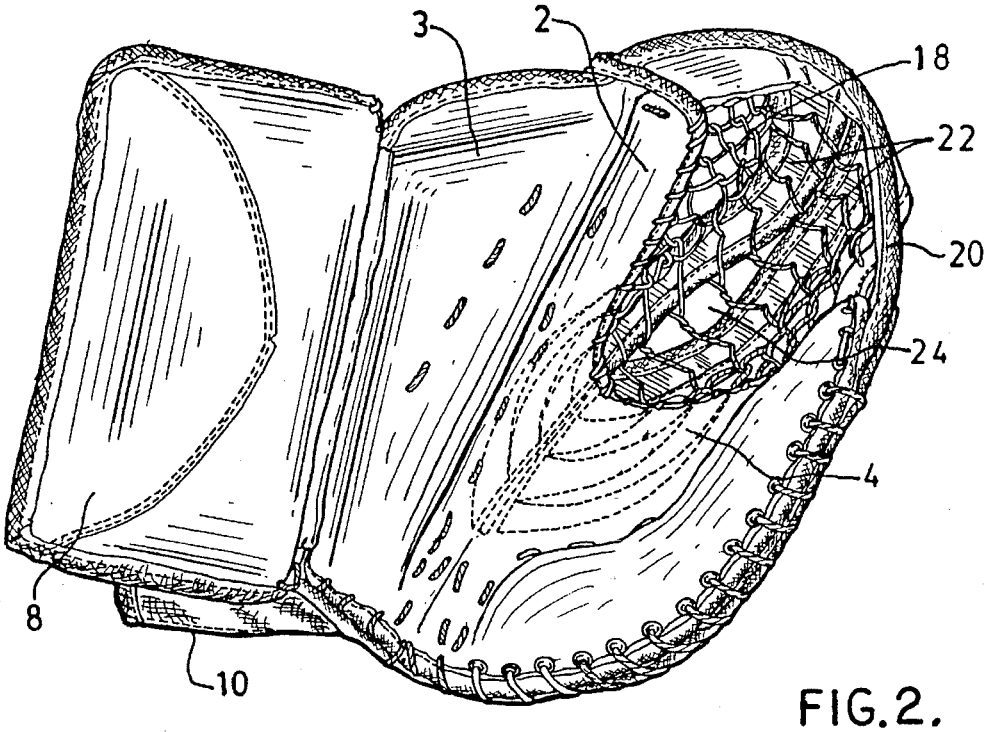
FIG. 2 is a perspective of the front of the glove, open.
Figure 3:
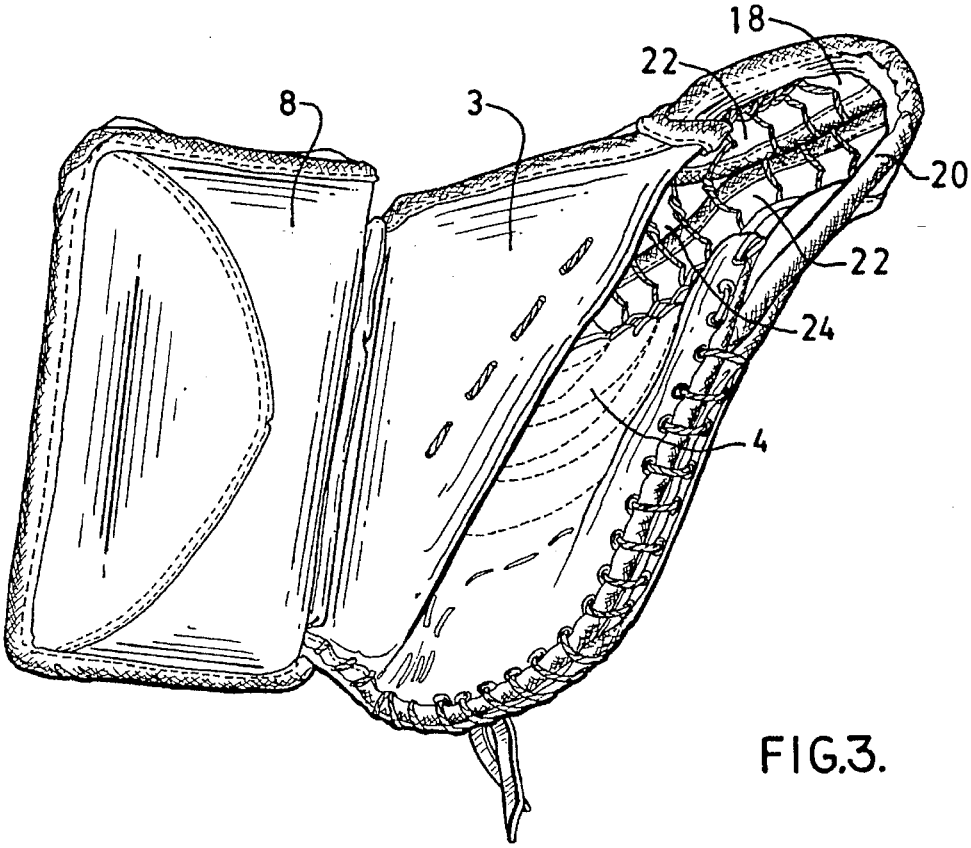
FIG. 3 is a perspective of the front of the glove, closed.

The result of this "split trap" configuration is that when the puck impacts the pocket (ideally in the area of the gap 24), the web portions 22 tend to fold over towards each other and around the puck, thus providing a more secure grip on the puck, and yet one which may be readily released by opening the glove to the position shown in FIG. 2.

In one embodiment of the invention, the pocket is approximately 20 cm across the top, tapering down to zero at the bottom. The distance from top to bottom of the pocket is approximately 30 cm. The web portions are each approximately 3 cm in width. The gap is approximately 12 cm long, and approximately 2.5 cm at its widest. It should of course be appreciated that these dimensions could be varied widely while still maintaining the principle of the invention.

Although no gap is essential, it should preferably be at least about 2 cm, to facilitate wrapping the web portions around the puck.

It will be appreciated that the above description relates to the preferred embodiment by way of example only. Many variations on the invention will be obvious to those knowledgeable in the field, and such obvious variations are within the scope of the invention as described and claimed, whether or not expressly described.

For example, it should be appreciated that the web portions 22 need not be completely separate elements. They could instead be provided by a single piece which is split in the middle to provide the desired gap. That is, the separate web portions could be provided either by two separate webs, or by a single web which is split into two portions.

I claim:

1. In a hockey goaltender's glove comprising a thumb area, a finger area, and a webbed pocket spanning between the thumb area and the finger area, the pocket having a top defined by a top web spanning from a tip of the thumb area to a tip of the finger area, and a bottom defined by an intersection of the thumb area with the finger area, the improvement comprising two web portions beside each other extending from approximately the middle of the top web down to the bottom of the pocket, tied via webbing such that they are separated from each other in at least a portion of the pocket, thus leaving a gap between said web portions, said gap being spanned by said webbing.

2. The improvement as recited in claim 1, wherein said gap is at least 2 cm at its widest portion.

3. In a hockey goaltender's glove comprising a thumb area, a finger area, and a webbed pocket spanning between the thumb area and the finger area, the pocket having a top defined by a top web spanning from a tip of the thumb area to a tip of the finger area, and a bottom defined by an intersection of the thumb area with the finger area, the improvement comprising a web extending from approximately the middle of the top web down to the bottom of the pocket, being split along at least a portion thereof to define two define portions beside each other, said web portions being tied via webbing such that they are separated from each other in at least a portion of the pocket, leaving a gap between said web portions, said gap being spanned by said webbing.

4. The improvement as recited in claim 3, where said gap is at least 2 cm at its widest portion.

* * * * *

UNITED STATES PATENT AND TRADEMARK OFFICE

CERTIFICATE OF CORRECTION

PATENT NO. : 5,511,244

DATED : April 30, 1996

INVENTOR(S) : Brian H. Shikatani

It is certified that error appears in the above-indentified patent and that said Letters Patent is hereby corrected as shown below:

IN THE CLAIMS:

Claim 2, line 47 change "wherein" to --where--.

Claim 3, line 57, change "two define portions" to --two web portions--

Signed and Sealed this

Seventeenth Day of June, 1997

*Attest:*

*Attesting Officer*

BRUCE LEHMAN

*Commissioner of Patents and Trademarks*